US007727942B2

(12) United States Patent
Wormuth et al.

(10) Patent No.: US 7,727,942 B2
(45) Date of Patent: Jun. 1, 2010

(54) LUBRICANT COATED SHEET METAL WITH IMPROVED DEFORMATION PROPERTIES

(75) Inventors: Reinhard Wormuth, Dortmund (DE); Dirk Liese, Geitling (DE)

(73) Assignees: TryssenKrupp Stahl AG, Duisburg (DE); Deutsche BP AG, Hamburg (DE)

( * ) Notice: Subject to any disclaimer, the term of this patent is extended or adjusted under 35 U.S.C. 154(b) by 1239 days.

(21) Appl. No.: 10/537,446

(22) PCT Filed: Dec. 2, 2003

(86) PCT No.: PCT/EP03/13557

§ 371 (c)(1),
(2), (4) Date: Nov. 9, 2005

(87) PCT Pub. No.: WO2004/050808

PCT Pub. Date: Jun. 17, 2004

(65) Prior Publication Data

US 2006/0100112 A1 May 11, 2006

(30) Foreign Application Priority Data

Dec. 3, 2002 (DE) ..... 102 56 639

(51) Int. Cl.
*C10M 137/04* (2006.01)
*C10M 137/06* (2006.01)
*C10M 135/36* (2006.01)

(52) U.S. Cl. ..... 508/162; 508/272; 508/363; 205/201

(58) Field of Classification Search ..... 508/272, 508/162, 363; 205/201
See application file for complete search history.

(56) References Cited

U.S. PATENT DOCUMENTS

| | | | | |
|---|---|---|---|---|
| 3,192,619 | A | 7/1965 | Rausch | |
| 3,220,233 | A | 11/1965 | Thomsen et al. | |
| 3,734,784 | A * | 5/1973 | Bereday et al. | 428/412 |
| 4,017,335 | A | 4/1977 | Maloney | |
| 4,313,836 | A * | 2/1982 | Nassry et al. | 508/276 |
| 4,846,898 | A * | 7/1989 | Natalie et al. | 428/469 |
| 4,878,963 | A * | 11/1989 | Bibber | 148/262 |
| 5,064,500 | A * | 11/1991 | Awad | 216/103 |

(Continued)

FOREIGN PATENT DOCUMENTS

CH 441 594 8/1967

(Continued)

OTHER PUBLICATIONS

International Search Report for PCT/EP2003/13557(in English and German).

(Continued)

*Primary Examiner*—Glenn Caldarola
*Assistant Examiner*—Jim Goloboy
(74) *Attorney, Agent, or Firm*—Proskaer Rose LLP

(57) ABSTRACT

The invention relates to sheet metal or a sheet metal blank provided with a lubricant coating, especially an anti-corrosion oil of the Pre-Lube or Dry Lube variety. The sheet metal or sheet metal blank comprises a layer which is formed by applying a solution containing an organic phosphoric acid ester to the metal surface of the sheet metal. Sheet metal provided with said coating has excellent tribological properties.

30 Claims, 1 Drawing Sheet

U.S. PATENT DOCUMENTS

| | | | | |
|---|---|---|---|---|
| 5,367,903 | A | 11/1994 | Keller | |
| 5,380,466 | A | 1/1995 | Martin | |
| 5,650,097 | A * | 7/1997 | Wysong et al. | 252/392 |
| 5,706,684 | A | 1/1998 | Gong et al. | |
| 6,478,885 | B1 | 11/2002 | Goodreau | |
| 2002/0006880 | A1 | 1/2002 | Guillement | |

FOREIGN PATENT DOCUMENTS

| | | | |
|---|---|---|---|
| DE | 100 07 625 | | 8/2001 |
| EP | 1 004 836 | | 9/1965 |
| EP | 0 146 140 | A2 | 6/1985 |
| EP | 0 546 357 | | 6/1993 |
| GB | 2 142 650 | A | 1/1985 |
| JP | 60202196 | | 10/1985 |
| JP | 63109175 | | 5/1988 |
| JP | 07090635 | | 4/1995 |
| WO | 91/03334 | | 3/1991 |
| WO | WO 0159045 | A1 * | 8/2001 |

OTHER PUBLICATIONS

Database WPI section Ch, Section Ch, Week 198547 Derwent Publications Ltd., London, GB; AN 1985-293423- XP002278226 & JP 60 202196 A (Hitachi LTD) Oct. 12, 1985 Abstract.

* cited by examiner

LUBRICANT COATED SHEET METAL WITH IMPROVED DEFORMATION PROPERTIES

SUMMARY OF THE INVENTION

The invention relates to a lubricant-coated metal sheet or a section thereof having improved forming properties, whereby the lubricant is in particular a corrosion protection oil, pre-lube and/or dry lube. The invention further relates to a method for the manufacture of such a metal sheet or metal sheet section, as well as to its use for the manufacture of metal bodies by forming, in particular by deep-drawing.

BACKGROUND

In the manufacture of metal sheets, such as steel sheets, it is common for these to be provided with a temporary corrosion protection for storage and transport immediately after the manufacturing or coating process and before delivery to the metal-processing industry. This is usually effected by applying a corrosion-inhibiting lubricant directly before the coiling of the sheet, such as a corrosion protection oil, a pre-lube or a dry-lube. If the metal sheet is destined for further processing by forming such as deep-drawing, the lubricants used can contain, in addition to corrosion-inhibiting substances, other ancillary substances, especially matched to the individual forming process, which improve the tribological properties of the sheet during the forming process. Metal sheets coated in this way are encountered, for example, in the automobile industry in the manufacture of bodywork made of metal sheets by deep-drawing.

With the use of lubricants for temporary corrosion protection and for improving the forming properties, it must be particularly borne in mind that these are to be easily and completely removable after the forming process.

From EP 0 489 105 B1 a method is known for the cold deep-drawing of metal sheets, in which the sheet which is to be deep-drawn and/or the deep-drawing tool are treated with an aqueous solution of an inorganic alkali phosphate and are then deep-drawn in the presence of a deep-drawing oil. The salt which is deposited on the sheet forms a soap under the pressure and temperature conditions of the deep-drawing process as a result of the reaction with the deep-drawing oil, which has the effect of reducing the friction coefficient. A disadvantage of the method is that the alkali phosphate used and the soap which is formed cannot be entirely removed from the sheet, free of any residue, after the deep-drawing.

From CH 441 594 a lubricant composition is further known for the cold-forming of metals without the removal of material, which contains a finely dispersed water-soluble inorganic salt for the improvement of the tribological properties, such as Borax. A disadvantage with this lubricant composition is that its lubrication capacity is not constant, since the salt is not distributed uniformly over the surface, which interferes with the deep-drawing process.

With the production of single-sided electrolytically galvanized fine sheet, very thin phosphating or borax passivation with a coating weight of approx. 10 mg/m2 has proved advantageous in respect of tribological properties. Both products can be applied in the existing flushing baths of the galvanizing lines, but they have the disadvantage that they may impair the phosphating process in the automobile production plant.

The use of prelubes takes account of the idea of influencing the tribological properties of steel strip directly on the surface of the steel. Prelubes contain drawing aids which are introduced into the oil coating, which is about 1 μm thick. Only the direct steel-tool interface is tribologically active, in the range of a few nanometers.

Finally, the principle is generally known of carrying out a surface treatment of the deep-drawn sheet in order to improve the tribological properties. In particular, chemical processes for the surface treatment are known, such as phosphating, by means of which the friction coefficient between the sheet and the tool is reduced, and the forming of the sheet section is thereby facilitated. Such a treatment, however, is expensive and cannot be applied to all deep-drawn sheets.

DETAILED DESCRIPTION OF THE INVENTION

It is an object of the present invention to provide a lubricant-coated metal sheet for the manufacture of metal bodies by forming, with improved tribological properties. The metal sheet should be easy to clean after the forming process and without any residues remaining. Finally, the manufacture of the lubricant-coated metal sheet should be capable of being carried out easily and without high investment expenditure in existing manufacturing facilities.

This object is achieved according to the invention by a metal sheet or a metal sheet section comprising a coating of lubricant, in particular a corrosion protection oil, pre-lube and/or dry-lube, whereby the metal sheet or the metal sheet section comprises a layer which is formed by the application of a solution containing an organic phosphoric acid ester onto the metallic surface of the sheet.

Surprisingly, it has been found that the lubricant-coated metal sheets according to the invention have excellent tribological properties as a consequence of their layer formed by the phosphoric acid ester. By contrast with lubricant-coated metal sheets without such a layer, the metal sheets according to the invention have a reduced friction coefficient. Finally, the metal sheets according to the invention can be easily cleaned after the forming process by existing degreasing systems, whereby both the layer containing the lubricant as well as the layer formed by the phosphoric acid ester can be removed from the surface of the sheet with no problem at all and without leaving any residue.

The metal sheets which are capable of being used according to the invention can be any desired metal sheets from which metal bodies can be manufactured by forming, in particular by cold forming. Particularly suitable metal sheets are steel sheets. The metal sheets which can be used according to the invention can be coated or uncoated. As an uncoated metal sheet, for example, consideration can be given to uncoated fine sheet metal, in particular conti-annealed uncoated fine sheet metal. As a coated metal sheet, consideration can be given in particular to electrolytically coated sheet, as well as to hot-dip galvanized and galvanized sheets. The metal sheets preferably have a thickness of 0.05 to 5 mm, and in particular from 0.5 to 1.5 mm.

The metal sheets and metal sheet sections according to the invention are coated with a lubricant which is intended to protect the sheets after manufacture, at least temporarily, against undesirable environmental influences, and in particular against corrosion manifestations. The choice of lubricant is not restricted; on the contrary, any substances containing grease or oil or the like, as well as dry lubricants such as graphite, come into consideration. The lubricants which can be used according to the invention preferably contain corrosion inhibitors. In addition, the lubricant can also contain further additives, in particular additives for improving the drawing properties of the sheets.

Such lubricants for the metalworking industry are in general known to the person skilled in the art, and are described, for example, in Nachtmann, "*Lubricants and lubrication in metalworking operations*", Marcel Decker, New York, 1985, pages 81 to 105; Byers, "*Metalworking fluids*", Marcel Decker, New York, 1994, pages 136 to 140, and Mortier, Orszulik, "*Chemistry and Technology of Lubricants*", 2nd edition, Chapman & Hall, London, 1997, pages 253 to 260.

According to a preferred embodiment of the invention, a corrosion protection oil is used as the lubricant. Such corrosion protection oils are generally known to the person skilled in the art, and usually contain a basic oil with an aromate content <10% and a corrosion inhibitor such as, for example, calcium sulphonate. In addition, the corrosion protection oils can also contain anti-oxidants for the prevention of oil aging, as well as thixotropy forming agents for reducing drip losses with oiled sheets.

According to a further preferred embodiment of the invention, a so-called "pre-lube" is used as a lubricant. Pre-lubes are corrosion protection oils with improved drawing properties, and as such are generally known to the person skilled in the art. The improvement of the drawing properties is achieved by the addition of further additives, e.g. of esters.

According to a further preferred embodiment of the invention, a so-called "dry lubricant" is used as a lubricant. Dry lubricants are thin films on wax and/or acrylate bases, with similar properties to pre-lubes, and as such as generally known to the person skilled in the art. In addition to this, dry lubricants also offer the possibility of manufacturing difficult drawing components in pressing plants without further additional lubrication. Drip losses from coated sheets are avoided entirely. Dry lubricants can be applied after smelting, for example by electrostatic means or by means of roll coaters.

According to the invention, a layer is formed on the metallic surface of the sheet, which can be obtained by the application of an organic phosphoric acid ester onto the metallic surface of the sheet.

Organic phosphoric acid esters which can be used according to the invention are, in particular, combinations of the general formula $$X_{3-n}PO_4R_n$$

where X represents hydrogen, Na, K, —$NH_2$, —NHR, —$NR_2$, —NH(R'—OH), —N(R'—OH)$_2$, or —NR(R'—OH), R represents a straight-chain or branched alkyl group with 1 to 14 carbon atoms, in particular 1 to 8, R' is a straight-chain or branched alkylene group with 1 to 14 carbon atoms, in particular 1 to 8, whereby one or more hydrogen atoms in R and R' can be substituted by a polymer or oligomer group—Y—R, where Y represents $(CH_2—CH_2—O—)_m$ or $(CH_2—CH(CH_3)—O—)_m$ with m=1 to infinity, and, in particular, m=1 to 10, R and R' can in each case be equal or different, and n is a number from 0 to 3, with the proviso that n is not 0 if X stands exclusively for hydrogen.

Particularly good results are achieved if, as an organic phosphoric acid ester, a combination of the formula given above is used, with X=H, R=$C_4H_9$ and n=1 or 2. Particularly preferred, in addition, is an equimolar mixture of $(C_4H_9—O)PO(OH)_2$ and $(OH)PO(O—C_4H_9)_2$.

According to a preferred embodiment of the invention, the layer formed by the phosphoric acid ester contains, as further components, a water-soluble organic sulphur compound and/or an organic molybdenum compound.

Suitable organic sulphur compounds according to the invention are, in particular, thiadiazoles, dithiocarbamates, and/or dithiopropionates, as well as their salts and derivatives.

Especially suitable organic sulphur compounds are, for example, sodium-2-mercaptobenzothiazole, 2,5-dimercapto-1,3,4-thiadiazole, as well as salts and derivatives thereof, sodium dimethyl dithiocarbamate, potassium dimethyl dithiocarbamate, and/or monoethanol amine dithiopropionate.

Organic molybdenum compounds which are suitable according to the invention can be obtained, for example, by the conversion of molybdenum trioxide and/or molybdeneic acid with an amine and/or alkanolamine.

According to a further preferred embodiment of the invention, the layer containing the phosphoric acid ester contains, as a further component, at least one inorganic compound from the group consisting of polyphosphates, borates, molybdates, and wolframates.

Inorganic compounds which are especially well-suited according to the invention are, for example, ammonium tripolyphosphate, sodium tetraborate, ammonium molybdate, sodium wolframate, potassium wolframate, and/or sodium wolframate.

Preferably, the organic phosphoric acid ester and any further components are applied onto the metal sheet in the form of an aqueous solution. After the application, the metal sheet is preferably dried.

The layer formed by phosphoric acid ester can be formed in any desired thicknesses. Preferably, however, this is a thin layer, in particular a coating in the nanometre range.

According to a further preferred embodiment of the invention, a layer containing a lubricant is formed directly onto a layer formed by phosphoric acid ester. The layer containing lubricant contains preferably a corrosion protection oil, pre-lube, and/or dry-lube. Preferably, the layer containing lubricant contains a corrosion protection oil.

The layer containing lubricant can be formed in any desired thicknesses. Particularly good tribological properties can be achieved if the layer containing lubricant is formed in a thickness of 0.3 to 3.0 g/m$^2$, in particular 1 to 2 g/m$^2$.

It has proved to be particularly advantageous if the layer containing lubricant is matched to the layer containing phosphoric acid ester in such a way that it contains components which are contained in the layer containing phosphoric acid ester.

It has been found that a synergistic effect can be incurred by this measure, and the tribological properties of the sheet are improved still further.

It is therefore advantageous if the layer containing lubricant contains at least one organic phosphoric acid ester as defined above, in a quantity from 0.01 to 50% by weight, and in particular 0.05 to 10% by weight.

It is further advantageous if the layer containing lubricant contains an aqueous organic sulphur compound as defined above, in a quantity from 0.005 to 50% by weight, in particular 0.01 to 30% by weight, and/or an organic molybdenum compound as defined above in a quantity from 0.005 to 50% by weight, in particular 0.01 to 30% by weight.

Finally, it is advantageous if the layer containing lubricant contains an inorganic compound as defined above in a quantity from 0.005 to 50% by weight, in particular 0.01 to 30% by weight.

The invention further relates to a method for the manufacture of the metal sheet according to the invention or metal sheet sections, comprising the following steps:

Application of a solution containing an organic phosphoric acid ester on the upper and/or lower side of the sheet, and Application of a lubricant onto the sheet coated in this way.

The application of the solution containing the organic phosphoric acid ester can be effected by any desired measures known to the person skilled in the art, such as immersion, spraying, brushing, or roll coating.

The procedure can be conveniently integrated into the existing work sequences in the manufacture of metal sheets. Accordingly, the application of the solution containing the phosphoric acid ester can be effected, for example, during the coating of the sheet in the flushing bath of a coating system or during the cooling of the sheet in the bath of a water cooling system. Preferably, the solution containing the phosphoric acid ester can be effected in the flushing bath of a coating system. The flushing bath in this situation is preferably arranged downstream as a single-step no-rinse post-treatment of the metallic coating process (e.g. electrolytic galvanizing). Within a production system, further production steps can be arranged downstream of the flushing bath. In particular, the metal sheet can be dried after the flushing bath in a suitable drier and/or coated subsequently with a lubricant (e.g. by electrostatic oiling).

The solution containing phosphoric acid ester is preferably applied as an aqueous solution.

The solution contains the phosphoric acid ester preferably in a quantity from 0.1 to 15% by weight, and in particular 3 to 8% by weight.

The pH of the solution is adjusted preferably to a value of 6.5 to 11, in particular 7.5 to 9.5.

According to a preferred embodiment of the invention, the solution contains as further components, as described above, a water-soluble organic sulphur compound, in particular one of the compounds described heretofore, and/or an organic molybdenum compound, in particular one of the compounds described heretofore, and/or one of the inorganic compounds described heretofore. The water-soluble organic sulphur compound(s) and/or organic molybdenum compound(s) are contained in the solution preferably in a quantity from 1 to 50% by weight, in particular from 5 to 25% by weight, related to the quantity of phosphoric acid ester.

The inorganic compound(s) are contained in the solution in a quantity from 1 to 50% by weight, in particular from 5 to 10% by weight, related to the quantity of phosphoric acid ester.

Before the application of the lubricant it is advantageous for the sheet to be dried.

As a lubricant, preferably a corrosion protection oil, pre-lube and/or dry-lube is used, as described heretofore. Preferably, the lubricant is matched to the solution containing the phosphoric acid ester to such an extent that it contains components as described heretofore (e.g. organic phosphoric acid ester, water-soluble organic sulphur compound, organic molybdenum compound, and/or inorganic compound), which are also contained in the solution containing the phosphoric acid ester.

The lubricant is applied preferably in a quantity from 0.3 to 3 g/m$^2$, in particular 1 to 2 g/m$^2$.

The invention accordingly also comprises the use of a solution containing an organic phosphoric acid ester as described heretofore, for the treatment of metal surfaces.

The object of the invention is further an aqueous solution for the treatment of metal surfaces containing an organic phosphoric acid ester and a water-soluble organic sulphur compound and/or an organic molybdenum compound, all compounds as described heretofore, as well as a concentrate for the production of such a solution.

Finally, the use of the metal sheet or metal sheet section according to the invention comprises the manufacture of metal, bodies by forming, in particular by deep-drawing.

DESCRIPTION

Figure 1B:
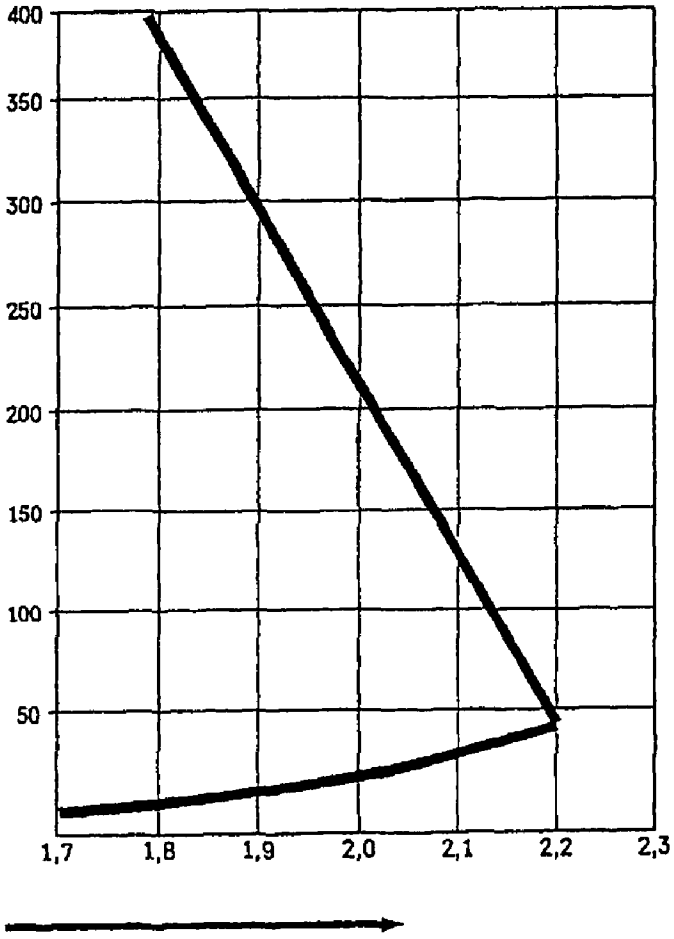
FIG. 1*b* is a graph of the deep-drawing working range for a sample coated in accordance with Example 2.

The invention is described in greater detail hereinafter on the basis of an embodiment.

Electrolytically galvanized steel sheets of a thickness of 1 mm were treated by immersion in an aqueous solution of the composition described heretofore, dried, and then coated with 1.5 g/m$^2$ pre-lube. To match the drawing performance, the friction coefficient was then determined in the draw-bed test. As a reference for the friction coefficient, a sample of the electrolytically galvanized steel sheet was used, which was not treated with an aqueous solution. The friction coefficient of this reference sample was set at 100%.

Example 1

An electrolytically galvanized steel sheet was treated with a 5% solution of an equimolar phosphoric acid ester mixture of $(CH_3—O)PO(OH)_2$ and $(OH)PO(O—CH_3)_2$. The sheet was dried and then coated with 1.5 g/m$^2$ pre-lube. The friction coefficient was 88%.

A reduction in the friction coefficient of 12% was determined in comparison with the reference sample without pre-treatment.

Example 2

An electrolytically galvanized steel sheet was treated with a 5% solution of an equimolar phosphoric acid ester mixture of $(C_4H_9—O)PO(OH)_2$ and $(OH)PO(O—C_4H_9)_2$. The sheet was dried and then coated with 1.5 g/m$^2$ pre-lube. The friction coefficient was 58%.

A reduction in the friction coefficient of 42% was determined in comparison with the reference sample without pre-treatment.

Example 3

An electrolytically galvanized steel sheet was treated with a 5% solution of an equimolar phosphoric acid ester mixture of $(C_8H_{17}—O)PO(OH)_2$ and $(OH)PO(O—C_8H_{17})_2$. The sheet was dried and then coated with 1.5 g/m$^2$ pre-lube. The friction coefficient was 90%.

A reduction in the friction coefficient of 10% was determined in comparison with the reference sample without pre-treatment.

Example 4

An electrolytically galvanized steel sheet was treated with a 5% solution of an equimolar phosphoric acid ester mixture of $(CH_3—[O—CH_2CH_2]_3—C_{12}H_{24}—O)PO(OH)_2$ and $(HO)PO(CH_3—[O—CH_2CH_2]_3—C_{12}H_{24}—O)_2$. The sheet was dried and then coated with 1.5 g/m$^2$ pre-lube. The friction coefficient was 92%.

A reduction in the friction coefficient of 8% was determined in comparison with the reference sample without pre-treatment.

Example 5

In this example, the deep-drawing working range of an electrolytically galvanized fine steel sheet manufactured in accordance with Example 2 was examined in relation to the reference sample without pre-treatment. The results of this examination are presented in FIG. 1.

Figure 1A:
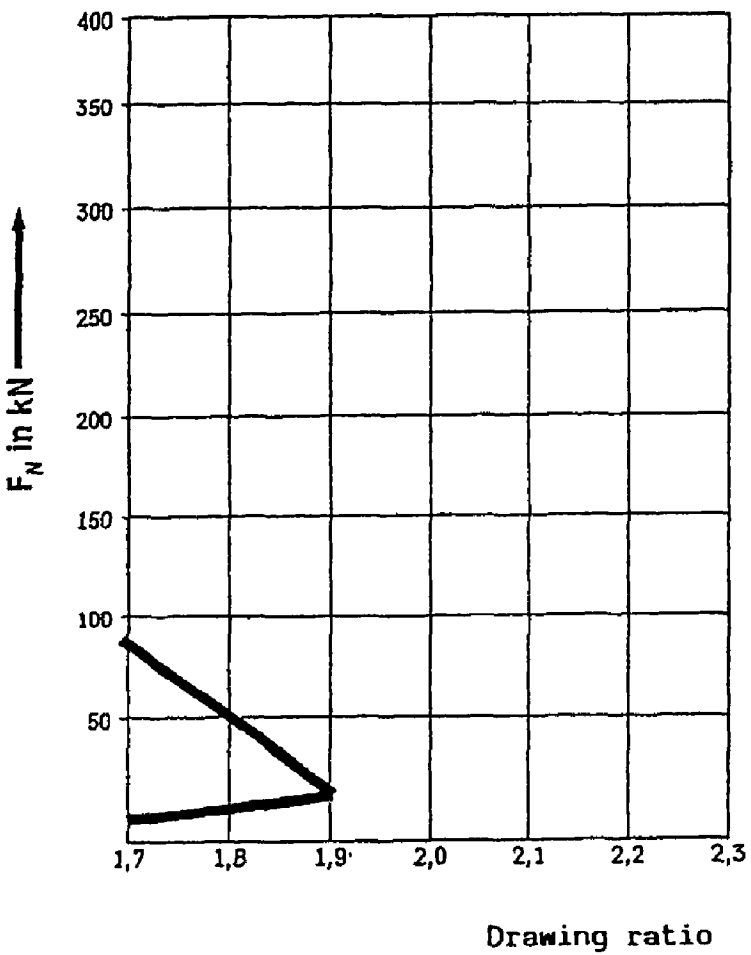
FIG. 1*a* is a graph of the deep-drawing working range (i.e., force versus drawing ratio) for a reference sample.

The results show that the fine sheet coated according to the invention (FIG. 1*b*) has a perceptibly greater deep-drawing working range than the reference sample without pre-treatment (FIG. 1*a*).

Comparison Example 1

An electrolytically galvanized steel sheet was treated with a 5% sodium tetraborate solution, dried, and then coated with 1.5 g/m$^2$ pre-lube. The friction coefficient was 9.0%.

A reduction in the friction coefficient of 10% was determined in comparison with the reference sample without pre-treatment.

Comparison Example 2

An electrolytically galvanized steel sheet was treated with a 5% phosphoric acid ester solution, dried, and then coated with 1.5 g/m$^2$ pre-lube. The friction coefficient was 95%.

A reduction in the friction coefficient of 5% was determined in comparison with the reference sample without pre-treatment.

The results show that the metal sheets according to the invention which were treated with a phosphoric acid ester solution have perceptibly improved tribological properties in comparison with metal sheets which were not subjected to such treatment, as well as an enlarged deep-drawing working range. The metal sheets according to the invention were also capable of being cleaned easily and entirely free of residue in a conventional degreasing system.

The invention claimed is:

1. A metal sheet or metal sheet section comprising a lubricant coating, wherein the metal sheet or the metal sheet section comprises a first layer and a second layer, the first layer being formed by the application onto the metallic surface of the metal sheet or metal sheet section of a solution containing an organic phosphoric acid ester, wherein the organic phosphoric acid ester is a compound of the general formula $$X_{3-n}PO_4R_n$$

where X stands for hydrogen, Na, K, —$NH_2$, —NHR, —$NR_2$, —NH(R'—OH)$_2$ or NR(R'—OH), R stands for a straight-chain or branched alkyl group with 1 to 8 carbon atoms, R' stands for a straight-chain or branched alkylene group with 1 to 14 carbon atoms, R and R' can in each case be equal or different, and n is a number from 0 to 3, with the proviso that n is not 0 if X stands exclusively for hydrogen, the solution containing phosphoric acid ester having a pH from 6.5 to 11, and the second layer including a lubricant and being arranged on the first layer.

2. The metal sheet or metal sheet section according to claim 1 wherein the organic phosphoric acid ester is a mixture of ($C_4H_9$—O)OP(OH)$_2$ and (OH)PO(O—$C_4H_9$)$_2$.

3. The metal sheet or metal sheet section according claim 1, wherein the solution containing the organic phosphoric acid ester contains, as further components, a water-soluble organic sulphur compound and/or an organic molybdenum compound.

4. The metal sheet or metal sheet section according to claim 3 wherein the organic sulphur compound is selected from the group consisting of thiadiazolene, dithiocarbamates and dithiopropionates as well as salts and derivatives thereof.

5. The metal sheet or metal sheet section according to claim 3, wherein the organic sulphur compound is selected from the group consisting of Sodium-2-mercaptobenzothiazole, 2,5-dimercapto-1,3,4-thiadiazole, as well as salts and derivatives thereof, sodium dimethyl dithiocarbamate, potassium dimethyl dithiocarbamate and monoethanol amine dithiopropionate.

6. The metal sheet or metal sheet section according to claim 3, wherein the organic molybdenum compound can be obtained by the conversion of molybdenum trioxide and/or molybdeneic acid with an amine and/or alkanolamine.

7. The metal sheet or metal sheet section according to claim 1 wherein the solution containing the phosphoric acid ester contains, as further components, at least one inorganic compound selected from the group consisting of polyphosphates, borates, molybdates and wolframates.

8. The metal sheet or metal sheet section according to claim 7, wherein the inorganic compound is selected from the group consisting of ammonium tripolyphosphate, sodium tetraborate, ammonium molybdate, sodium wolframate, potassium wolframate and sodium wolframate.

9. The metal sheet or metal sheet section according to claim 1, wherein the first layer is formed as a thin layer in the nano range.

10. The metal sheet or metal sheet section according to claim 1, wherein the second layer is formed in a thickness from 0.3 to 3.0 g/m$^2$.

11. The metal sheet or metal sheet section according to claim 1, wherein the second layer includes the organic phosphoric acid ester in a quantity from 0.01 to 50% by weight.

12. The metal sheet or metal sheet section according to claim 1, wherein the lubricant of the second layer contains a water-soluble organic sulphur compound in a quantity from 0.005 to 30% by weight.

13. The metal sheet or metal sheet section according to claim 1, wherein the lubricant of the second layer contains an organic molybdenum compound in a quantity from 0.005 to 30% by weight.

14. The metal sheet or metal sheet section according to claim 1, wherein the lubricant of the second layer contains an organic compound in a quantity from 0.005 to 30% by weight.

15. The metal sheet or metal sheet section according to claim 1 wherein the sheet is a coated or uncoated steel sheet.

16. The method for the manufacture of a metal sheet section according to claim 1, wherein application of a solution including an organic phosphoric acid ester on the upper and/or lower side of the sheet, and applications of a lubricant onto the sheet coated in this way.

17. The method according to claim 16, wherein the application of the solution including the organic phosphoric acid ester is effected by immersion, spraying, brushing, or roll coating.

18. The method according to claim 16, wherein the application of the solution including the organic phosphoric acid ester is effected during the coating of the sheet in the flushing bath of a coating system or during the cooling of the sheet in the bath of a water cooling system.

19. The method according to claim 16, wherein an aqueous solution of the organic phosphoric acid ester is applied.

20. The method according to claim 16, wherein the solution applied includes the organic phosphoric acid ester in a concentration from 0.1 to 15% by weight.

21. The method according to claim 16, wherein the solution applied includes as further components a water-soluble organic sulphur compound and/or an organic molybdenum compound.

22. The method according to claim 21, wherein the solution applied includes the water-soluble organic sulphur compound(s) and/or organic molybdenum compound(s) in a quantity from 1 to 50% by weight related to the quantity of phosphoric acid ester.

23. The method according to claim 16, wherein the solution applied includes as further components at least one inorganic compounds from the group consisting of polyphosphates, borates, molybdates and wolframates.

24. The method according to claim 23, wherein the solution applied includes the inorganic compounds in a quantity from 1 to 50% by weight related to the quantity of phosphoric acid ester.

25. The method according to claim 16, wherein the sheet is dried before the lubricant is applied.

26. The method according to claim 16 wherein the lubricant is selected from the group consisting of corrosion protection oil, pre-lube, dry-lube, and combinations thereof.

27. The method according to claim 16, wherein the lubricant is applied in a quantity from 0.3 to 3.0 $g/m^2$.

28. An aqueous solution for the treatment of metal surfaces comprising the organic phosphoric acid ester of claim 1, a water-soluble organic sulphur compound selected from the group consisting of thiadiazolene, dithiocarbamates and dithiopropionates as well as salts and derivatives thereof, and an organic molybdenum compound obtainable by the conversion of molybdenum trioxide and/or molybdeneic acid with an anime and/or alkanolamine.

29. The aqueous solution according to claim 28, further comprising at least one organic compounds selected from the group consisting of polyphosphates, borates, molybdates and wolframates.

30. A concentrate for the manufacture of a solution for the treatment of metal surfaces according to claim 28.

* * * * *

UNITED STATES PATENT AND TRADEMARK OFFICE

CERTIFICATE OF CORRECTION

PATENT NO. : 7,727,942 B2
APPLICATION NO. : 10/537446
DATED : June 1, 2010
INVENTOR(S) : Wormuth et al.

It is certified that error appears in the above-identified patent and that said Letters Patent is hereby corrected as shown below:

On the Title page, under Assignees, delete "TryssenKrupp" and replace it with --ThyssenKrupp--

In claim 1, at column 7, line 47, delete "$NH(R'\text{-}OH)_2$" and replace it with --$NH(R'\text{-}OH)$, - $N(R'\text{-}OH)_2$--

Signed and Sealed this

Twenty-eighth Day of September, 2010

David J. Kappos

David J. Kappos
*Director of the United States Patent and Trademark Office*